US007409797B2

(12) United States Patent
Pound et al.

(10) Patent No.: US 7,409,797 B2
(45) Date of Patent: Aug. 12, 2008

(54) SELF-FASTENING GLASS ATTACHMENT CLIP

(75) Inventors: Keith Pound, Troy, MI (US); Kim Margerum, Nashville, TN (US); Benjamin Mullinix, Bedford, TX (US)

(73) Assignee: ArvinMeritor Technology, LLC, Troy, MI (US)

( * ) Notice: Subject to any disclaimer, the term of this patent is extended or adjusted under 35 U.S.C. 154(b) by 901 days.

(21) Appl. No.: 10/677,197

(22) Filed: Oct. 2, 2003

(65) Prior Publication Data

US 2005/0072051 A1 Apr. 7, 2005

(51) Int. Cl.
*E05F 11/38* (2006.01)

(52) U.S. Cl. ..... 49/375

(58) Field of Classification Search ..... 49/348, 49/349, 350, 351, 374, 375
See application file for complete search history.

(56) References Cited

U.S. PATENT DOCUMENTS 4,611,850 A 9/1986 Fujikawa
4,663,901 A 5/1987 Ichinohe
4,754,586 A 7/1988 Fujikawa
4,991,351 A * 2/1991 Bertolini ..... 49/351
5,065,545 A 11/1991 Kane et al.
5,243,785 A * 9/1993 Nieboer et al. ..... 49/375
5,515,651 A 5/1996 Hofmann et al.
5,907,927 A * 6/1999 Lieb et al. ..... 49/375
6,205,711 B1 * 3/2001 Klippert ..... 49/375
6,233,873 B1 * 5/2001 Lawrie et al. ..... 49/375
6,519,898 B2 * 2/2003 Tatsumi et al. ..... 49/375
6,557,302 B1 * 5/2003 Kaps ..... 49/375
6,588,152 B2 * 7/2003 Cabbane ..... 49/375
6,729,073 B2 * 5/2004 Nicolai ..... 49/375

* cited by examiner

*Primary Examiner*—Jerry Redman
(74) *Attorney, Agent, or Firm*—Carlson, Gaskey & Olds

(57) ABSTRACT

A self-fastening window attachment clip is disposed within a cursor attached to a window lift mechanism. The clip includes a locking portion engaged with an attachment member secured to a window and received within a slot of the cursor. The clip includes a locking portion and a biasing portion that secures the attachment member within the cursor. The clip is disposed within the cursor and orientated such that insertion of the attachment member flexes the locking portion out or the slot. With the attachment member in contact with the biasing portion, the locking portion is free to spring back across the slot and engage a top portion of the attachment member. The locking portion engages the attachment member and prevents removal of the attachment member from the slot of the cursor.

14 Claims, 4 Drawing Sheets

SELF-FASTENING GLASS ATTACHMENT CLIP

BACKGROUND OF THE INVENTION

This invention generally relates to window lifting assembly and specifically to a self-fastening attachment clip for securing a window to a window lifting mechanism.

Conventional window lifting assemblies include a window attached to a lifting mechanism for moving the window between an open and closed position. Typically, the window is secured to a securing member, commonly referred to as a cursor that is in turn attached to the lifting mechanism. The lifting mechanism is in turn driven by an electric motor, or manually by rotation of a hand crank.

Typically, the window is secured to the lifting mechanism by an attachment member extending from the window that is locked within the cursor. The attachment member is often a bolt, a threaded rod or stud fastened to the window. During assembly, the attachment member is received within a slot of the cursor and secured therein. Attachment of the window to the lifting mechanism should be quick, efficient and cost effective in order to provide ease of assembly.

One example of a current device for securing a window to a lifting mechanism includes an elaborately molded cursor. The cursor includes an integrally molded clip that locks onto an attachment member secured to the window. The attachment member is a cylindrical stud that extends from the window. The integrally molded clip includes a pair of opposing legs that correspond to the shape of the attachment member. The window is received within a longitudinal slot in the cursor and the attachment member is received within a transverse slot. The attachment member expands the legs of the clip outward as it passes the clip. The legs than spring back into position to trap the attachment member within the cursor. Molded cursors of this type provide quick assembly. However, the intricate molding of the cursor may be expensive, and a relatively complex mold is required.

Accordingly, it is desirable to design a cost efficient, easily assembled attachment mechanism for securing a window to a lifter mechanism.

SUMMARY OF INVENTION

An embodiment of this invention includes a window lift mechanism having a clip disposed within a cursor. A window having an attachment member is received within the cursor and the attachment member is locked within the cursor between a locking portion and a bias portion of the clip.

The window lift assembly includes a window secured within cursors supported on the lifting mechanism. The attachment member and the window are received within slots of the cursor. A locking portion and a biasing portion of the clip secures the attachment member to the cursor. The clip is disposed within the cursor and orientated such that insertion of the attachment member moves the locking portion out of the slot.

The attachment member moves downward within the slot until contacting the biasing portion of the clip. The locking portion of the clip springs back into a locking position once the attachment member has contacted the biasing portion. The locking portion engages the attachment member and prevents removal of the attachment member from the slot of the cursor.

Another clip according to the present invention is a single continuous resilient strand with first and second segments. The locking portion is adjacent the first segment and the biasing portion is adjacent the second segment. The locking portion moves aside as the attachment member and the window are received within the cursor. The locking member spring back into the locking position, preventing removal of the window. The bias portion biases the attachment member into engagement with the locking portion.

Accordingly, the window lift mechanism of this invention allows easy installation of a window to a lifting mechanism and positive retention of the window once secured with the cursor.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
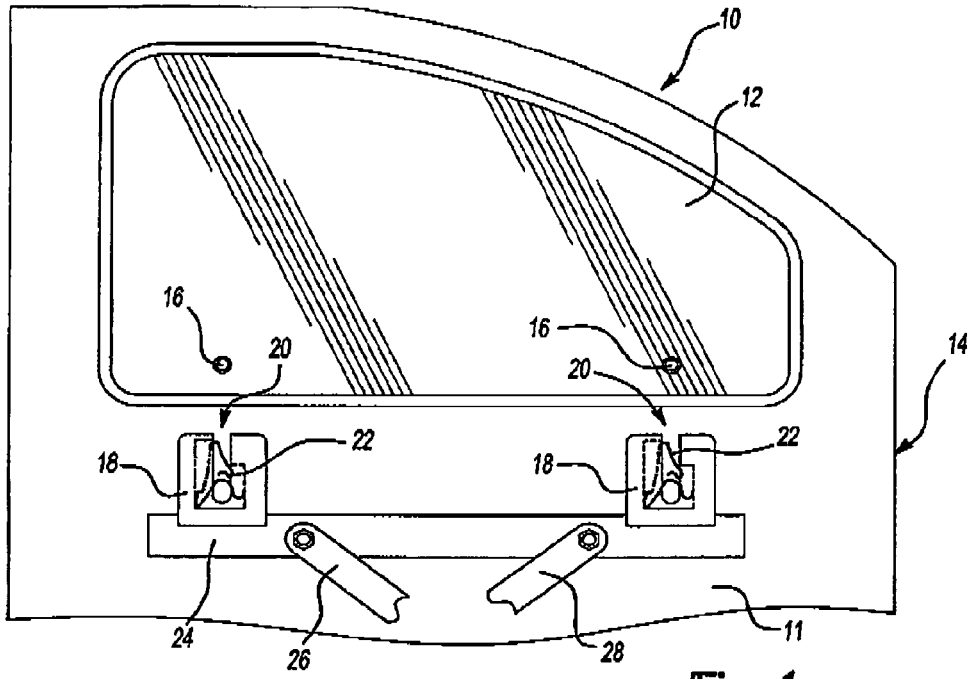
FIG. 1 is a plan view of a window lifter mechanism.

Referring to FIG. 1, a window lift assembly 10 includes a window 12 secured within cursors 18 supported on a lifting mechanism 14. The window lift mechanism is supported within a vehicle door 11. The window 12 includes at least one attachment member 16 received within a slot 20 of the cursor 18. The attachment member 16 is secured within the cursor 18 by a clip 22. The clip 22 includes a locking portion 32 and a biasing portion 34 that secures the attachment member 16 within the cursor 18.

The attachment member 16 extends perpendicularly from the window 12 and is received within slots 20 of the cursors 18. The cursors 18 are supported on the lifter mechanism 14. The lifter mechanism 14 includes a first member 24 that supports the cursors 18. Second and third members 26,28 are attached to the first member 24 and to additional lifting mechanisms (not shown) that are driven by an electric motor or by a hand crank as is known. As appreciated, the illustrated lift mechanism 14 is only an example of a lift mechanism compatible with this invention. Other lift mechanisms are also within the contemplation of this invention.

Figure 2:
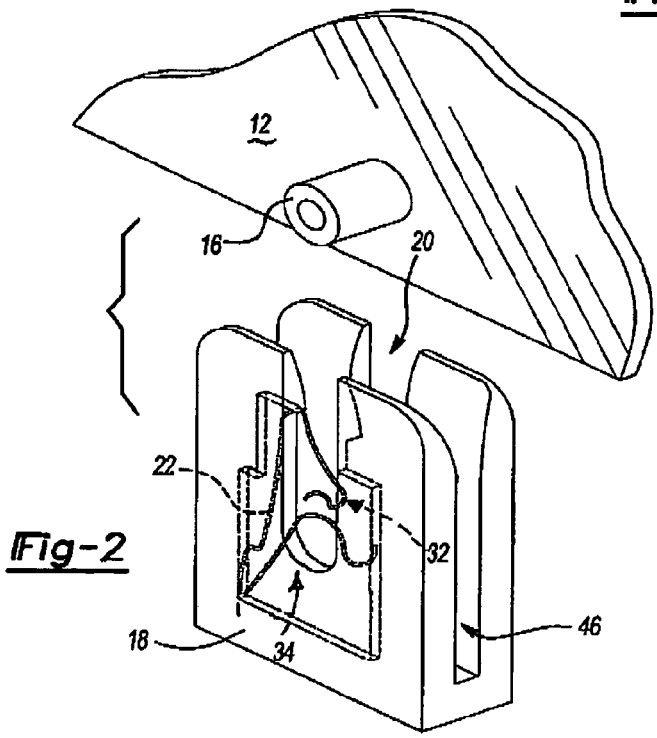
FIG. 2 is a perspective view of the cursor and window.
Figure 3:
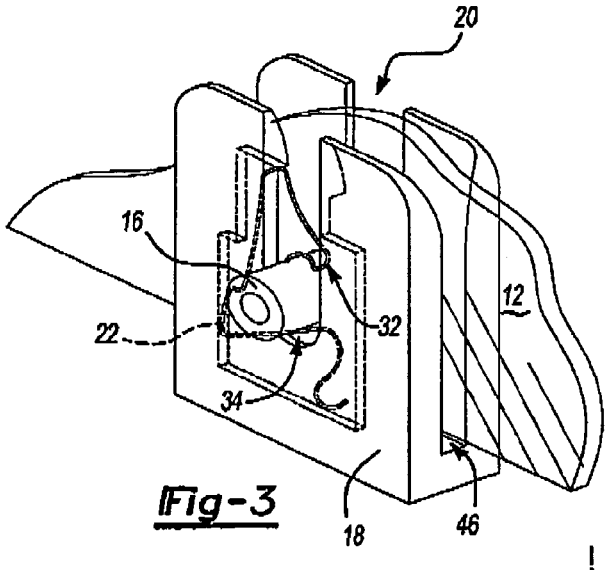
FIG. 3 is a perspective view of the window received within the cursor.

Referring to FIGS. 2 and 3, each cursor 18 includes a channel 46 for receiving the window 12 and a slot 20 for receiving the attachment member 16. The clip 22 is disposed within the cursor 18 and orientated such that insertion of the attachment member 16 bends the locking portion 32 out of the slot 20. The attachment member 16 is received within the slot 20 and contacts the biasing portion 34 of the clip 22. With the attachment member 16 in contact with the biasing portion 34, the locking portion 32 is free to spring back across the slot 20 and engages a top surface of the attachment member 16. The locking portion 32 preferably includes a profile corresponding to the attachment member 16. The locking portion 32 engages the attachment member 16 and prevents removal from the slot 200*f* the cursor 18.

Figure 4:
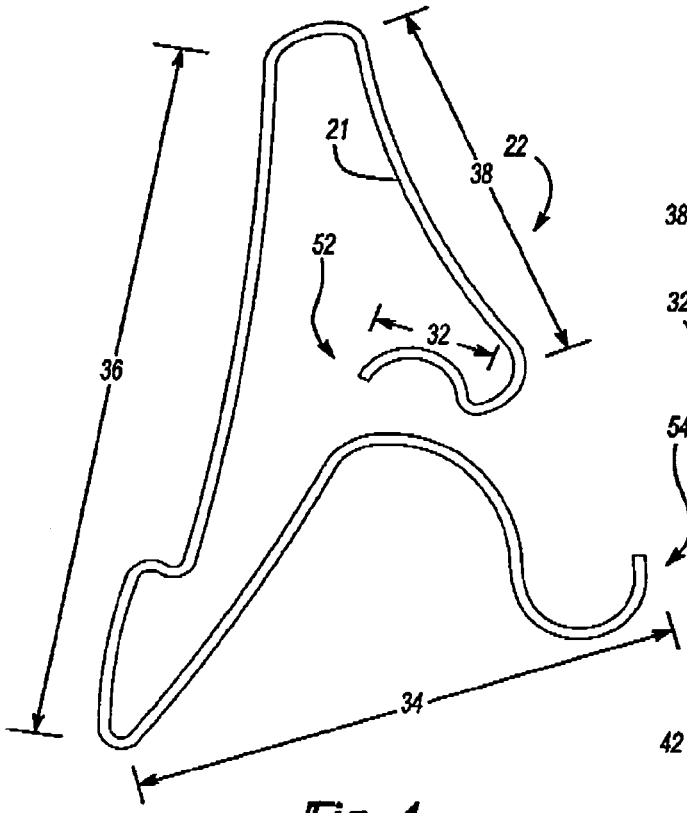
FIG. 4 is a front view of the clip
Figure 5:
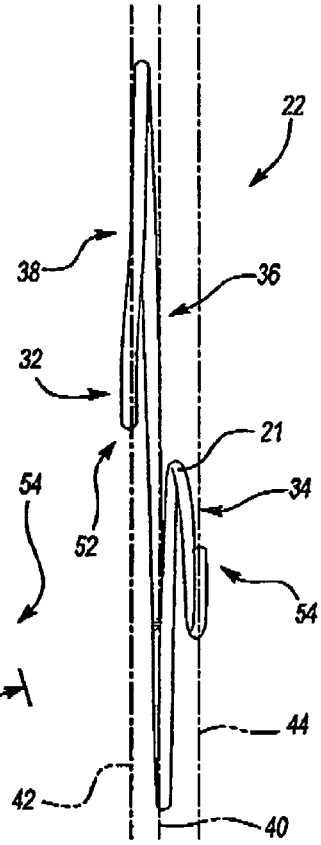
FIG. 5 is a side view of the clip.

Referring to FIGS. 4 and 5, the clip 22 includes a sliding portion 38 adjacent the locking portion 32. The sliding portion 38 and biasing portion 34 are separate elements attached by a body portion 36 of the clip 22. The clip 22 comprises a single continuous resilient strand 21 having first and second segments 50,52. The locking portion 32 is adjacent the first segment 52 and the bias portion 34 is adjacent the second segment 54. The clip 22 bends to allow the attachment member 16 to slide by the locking portion 32. The window 12 is received and locked within the cursor 18 by pushing the window 12 and attachment member 16 fully into the slot 20.

The body portion 36 connecting the locking portion 32 and the biasing portion 34 defines a first central plane 40. The locking portion 32 is angled away from the first central plane 40 and defines a second plane 42. Because the locking portion 32 is on a different plane than the body portion 36, the locking portion 32 can flex toward and past the body portion 36 to allow the attachment member 16 to pass within the slot 20 toward and into contact with the biasing portion 34. The biasing portion 34 defines a third plane 44 opposite the second plane 42 and different from the first center plane 40. 40. The position of the planes 40,42,44 of the clip 22 stabilizes the clip 22 within the cursor 18. It should be understood that the biasing portion 34, locking portion 32 and body portion 36 generally define a planar spatial relationship and need not be fully confined within a single plane.

Figure 6A:
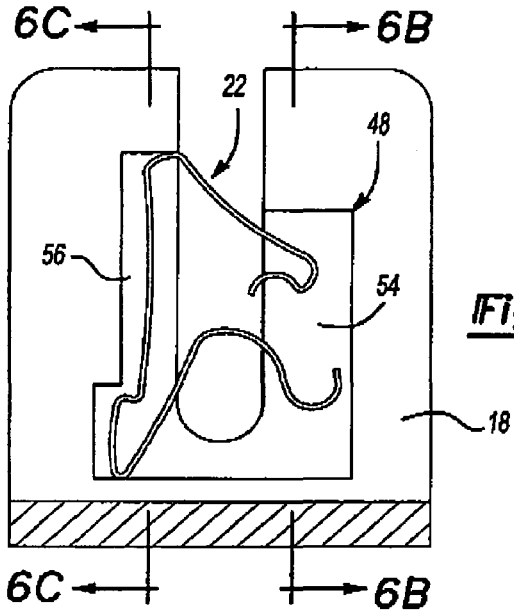
FIG. 6A is a plan view of the back of the cursor.
Figure 6C:
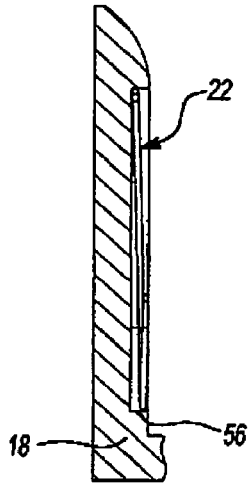
FIG. 6C is another cross-sectional view of the cursor shown in FIG. 6A.
Figure 6B:
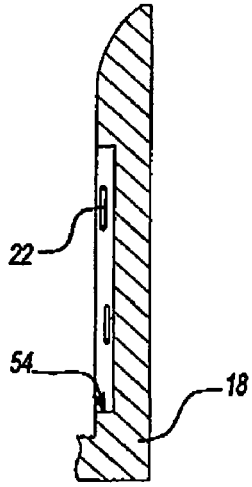
FIG. 6B is a cross-sectional view of the cursor shown in FIG. 6A.

Referring to FIGS. 6A-C, a cursor 18 includes a cavity 48 adapted for retention of the clip 22. The clip 22 is positioned within the cavity 48 to prevent removal from the cursor 18 upward through the slot 20. The cavity 48 includes sections portions disposed on either side of the slot 20 that support the clip 22 and prevent upward movement and removal of the clip 22 from the slot 20.

Figure 7B:
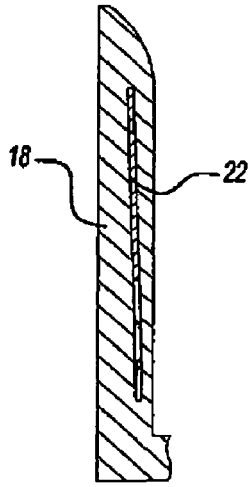
FIG. 7B is a cross-sectional view of the cursor shown in FIG. 7A.
Figure 7A:
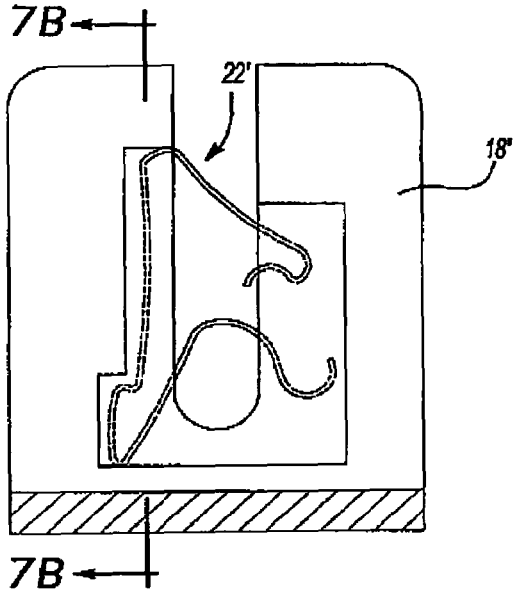
FIG. 7A is a plan view of the back of another embodiment of the cursor.

Referring to FIGS. 7A-B, another clip 22' is molded into the cursor 18' using known insert molding techniques. It is within the contemplation of this invention to use known molding techniques to secure the clip 22 within the cursor 18, for example, molded tabs, clips, or separate fasteners.

Figure 8:
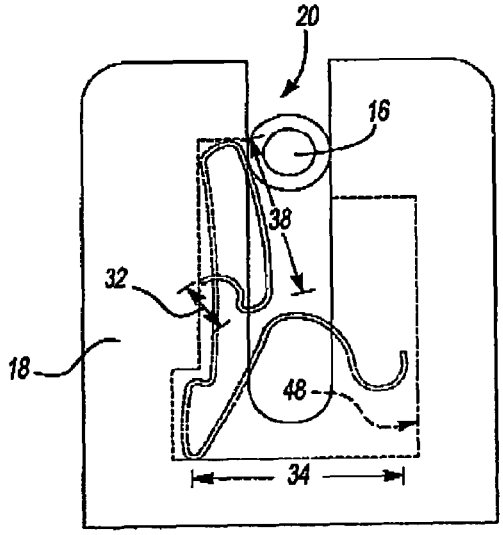
FIG. 8 is a schematic view of the attachment member engaged to a portion of the clip.
Figure 9:
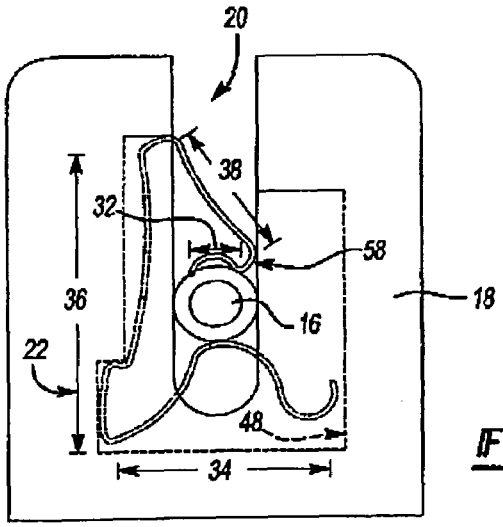
FIG. 9 is a schematic view of the attachment member fully secured within the cursor by the clip

Referring to FIGS. 8 and 9, FIG. 8 illustrates initial entry of the attachment member 16 into the slot 20 and FIG. 9 illustrates locking of the attachment member 16 by the clip 22. In operation, the attachment member 16 moves within the slot 20 and contacts the slide portion 38 of the clip 22 to force the locking portion 32 aside and out of the slot 20. The sliding portion 38 is pushed aside by downward movement of the attachment member 16 within the slot 20. Because the locking portion 32 is on a different plane than the body portion 36 (FIG. 5), the locking portion 32 pushes past the body portion 36 to allow the attachment member 16 to be completely received within the slot 20. Once the attachment member 16 has passed the locking portion 32, the locking portion 32 springs back across the slot 20 to the original shape of the clip 22. Upward force on the window 12 and the attachment member 16 forces first and second corners 58,60 of the clip 22 into contact with surfaces of the cavity 48 of the cursor 18, preventing removal of the attachment member 16.

The attachment member 16 may be removed by moving the locking portion 32 aside with a tool such as a flat tipped screwdriver, to clear the slot 20. Removal of the window 12 is therefore possible for maintenance and repair by moving aside the locking portion 32 to clear the slot 20 from obstruction by the clip 22. However, with the locking portion 32 engaged, the attachment member 16 is not removable from the slot 20. Further, the attachment member 16 is trapped between the locking portion 32 and the biasing portion 34, providing a tight secure fit. The bias portion 34 biases the attachment member 16 into engagement with the locking portion 32, securing the attachment member 16 tightly within the cursor 18.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A window lift mechanism assembly for a window having at least one attachment member comprising;

a cursor adapted to receive the attachment member, and at least one strand disposed within said cursor comprising a locking portion for securing the attachment member within said cursor.

2. The assembly of claim 1,wherein said locking portion includes a profile to engage the attachment member.

3. The assembly of claim 1, wherein the curser includes a slot for receiving the attachment member.

4. The assembly of claim 3, wherein the slot includes a cavity adapted for retention of said at least one strand.

5. The assembly of claim 1,wherein said at least one strand is not removable from said cursor.

6. The assembly of claim 1, wherein said cursor is adapted to receive the attachment member and said at least one strand is adapted to trap the attachment member between the locking portion and a bias portion.

7. The assembly of claim 1, wherein a portion of said at least one strand is integrally molded into said cursor.

8. The assembly as recited in claim 1, wherein said at least one strand includes a biasing portion.

9. A door module assembly comprising:

a window lift mechanism;

a window including at least one attachment member;

a cursor attached to said window lift mechanism, said cursor comprising an opening to receive said attachment member; and at least one continuous strand disposed within said cursor comprising a locking portion for securing said attachment member within said cursor.

10. The assembly as recited in claim 9, wherein said at least one strand includes a biasing portion.

11. A cursor assembly attachable to a window having an attachment member comprising:

a cursor; and at least one strand supported by said cursor and comprising a locking portion engageable with the attachment member of the window for securing said cursor to the window.

12. The assembly as recited in claim 11, wherein said strand includes a slide portion engageable to move said locking portion aside until the attachment member is past said locking portion.

13. The assembly as recited in claim 11, wherein said cursor includes a slot for receiving the attachment member.

14. The assembly as recited in claim 13, wherein said cursor includes a cavity adjacent said slot for supporting said strand.

* * * * *